US006220980B1

(12) United States Patent
Adler

(10) Patent No.: US 6,220,980 B1
(45) Date of Patent: Apr. 24, 2001

(54) MOLDED BALL WITH FINS

(76) Inventor: Alan J. Adler, 752 La Para Ave., Palo Alto, CA (US) 94306

( * ) Notice: Subject to any disclaimer, the term of this patent is extended or adjusted under 35 U.S.C. 154(b) by 0 days.

(21) Appl. No.: 09/102,974

(22) Filed: Jun. 22, 1998

Related U.S. Application Data

(60) Provisional application No. 60/051,113, filed on Jun. 27, 1997.

(51) Int. Cl.[7] ..... A63B 43/00

(52) U.S. Cl. ..... 473/613; 473/612

(58) Field of Search ..... 473/612, 613, 473/614, 573, 574, 596

(56) References Cited

U.S. PATENT DOCUMENTS

| | | | | |
|---|---|---|---|---|
| 115,252 | * | 5/1871 | Spencer | 473/612 |
| 3,046,016 | * | 7/1962 | Laws | 473/612 |
| 4,581,299 | * | 4/1986 | Jager | 473/612 |
| 5,236,196 | * | 8/1993 | Blankenburg et al. | 473/612 |
| 5,480,143 | * | 1/1996 | McMurry | 473/613 |
| 5,800,244 | * | 9/1998 | Barton, Jr. | 473/612 |

* cited by examiner

*Primary Examiner*—Steven Wong
(74) *Attorney, Agent, or Firm*—Townsend and Townsend and Crew LLP

(57) ABSTRACT

An injection molded thermoplastic ball comprising a plurality of thin fins radiating from a central member. The fins are oriented so as to radiate at substantially right angles from a central parting line plane.

5 Claims, 3 Drawing Sheets

MOLDED BALL WITH FINS

CROSS-REFERENCE TO RELATED APPLICATION

This application claims priority from U.S. Provisional Application No. 60/051,113, filed Jun. 27, 1997, of Alan J. Adler, entitled "MOLDED BALL WITH FINS," the disclosure of which is incorporated by reference in its entirety for all purposes.

BACKGROUND AND SUMMARY OF THE INVENTION

It is well known that thermoplastic injection molding requires a part design limited to relatively thin walls (for rapid cooling in the mold) and having an overall geometry which permits release from the mold when the mold is opened. These requirements are inconsistent with the geometry of balls.

Currently balls are made by other manufacturing processes such as, rotational molding, blow molding or thermoset molding.

The present invention is a ball suited to injection molding from soft thermoplastic elastomer. In addition, the ball of the present invention can be made very soft and compressible.

DESCRIPTION OF SPECIFIC EMBODIMENTS

Figure 1B:
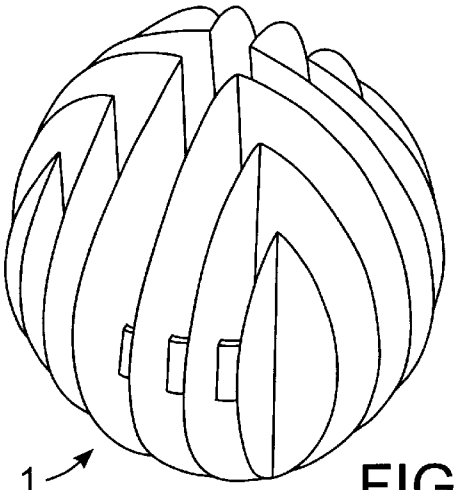
FIG. 1B is a perspective view of the ball of FIG. 1A.
Figure 1C:
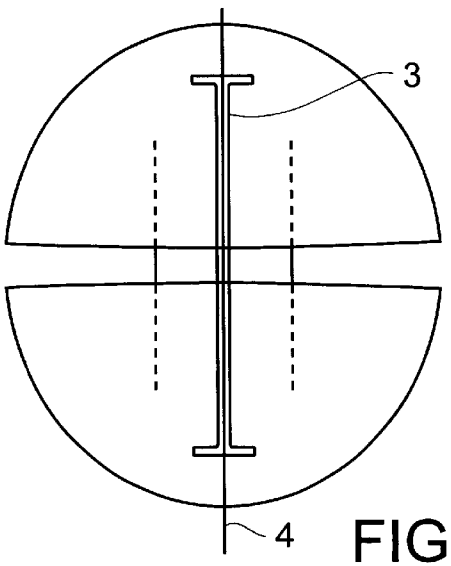
FIGS. 1C and 1D are elevation cross-section views of the ball of FIG. 1A taken along lines 1C—1C and 1D—1D.
Figure 1D:
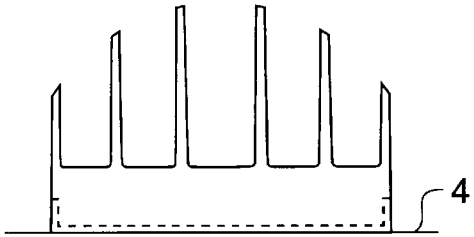
Figure 1A:
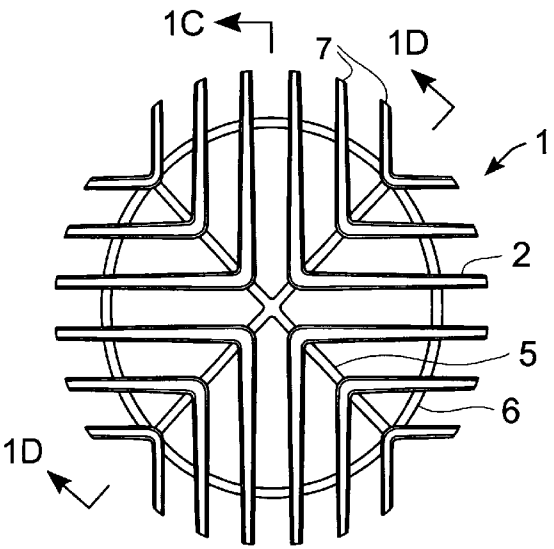
FIG. 1A is a plan view of a ball embodiment of the present invention.

The "parting line plane" is defined herein as a geometric plane which is parallel to the platens of the injection molding machine and thus perpendicular to the opening and closing stroke of the molding machine. The parting line plane is coincident with all or part of the actual parting line of the molded part. The actual parting line may be either planar or non-planar.

FIGS. 1A, 1B, 1C, and 1D show a ball 1 according to an embodiment of the invention. Ball 1 comprises a plurality of fins 2, the outermost edges of the fins defining a substantially spherical form, and the fins all joining a central member 3. Note that the fins are all oriented so as to radiate at substantially right angles from a central parting line plane 4 which bisects ball 1 (FIG. 1D only shows the half of the ball above parting line plane 4; the half below is identical). This permits release when the mold opens at the parting line.

Ball 1 comprises a central plate 3 adjacent to central parting line plane 4, and stabilizing ribs 5, 6 which stabilize the fins in relation to the central plate.

To facilitate both filling of and release from the mold, it is desirable that fins 3 should be tapered with their maximum thickness at the root nearest the central member and their minimum thickness at their outermost edges 7.

Figure 2B:
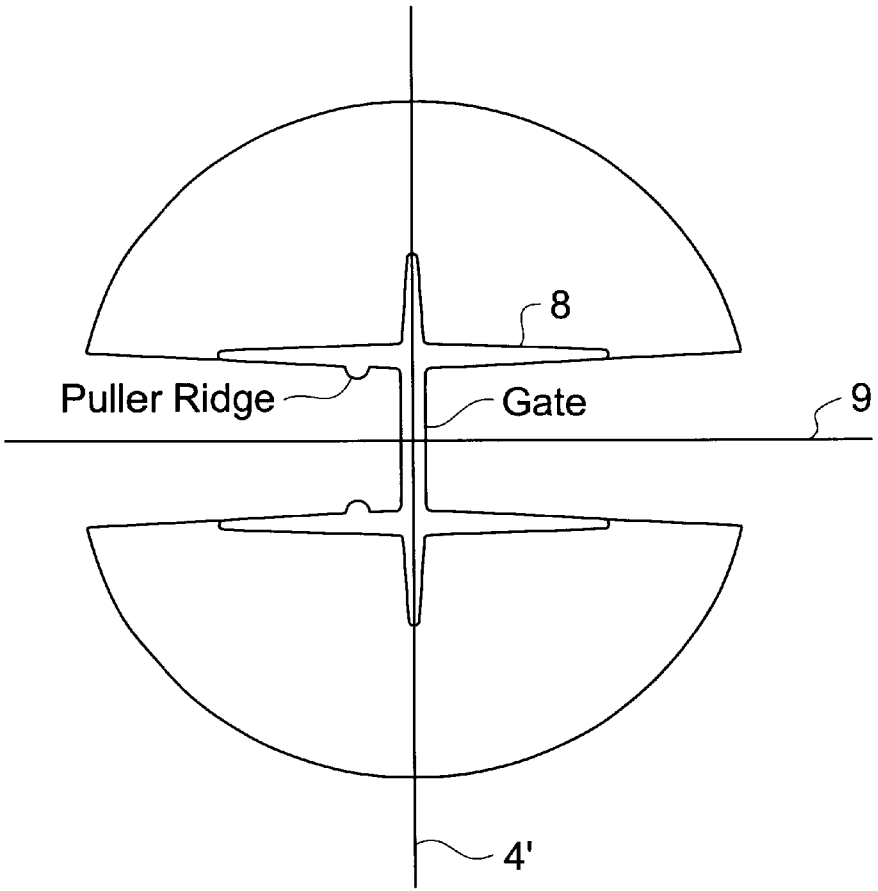
FIGS. 2A and 2B are plan and elevation views of an alternative ball embodiment of the invention.
Figure 2A:
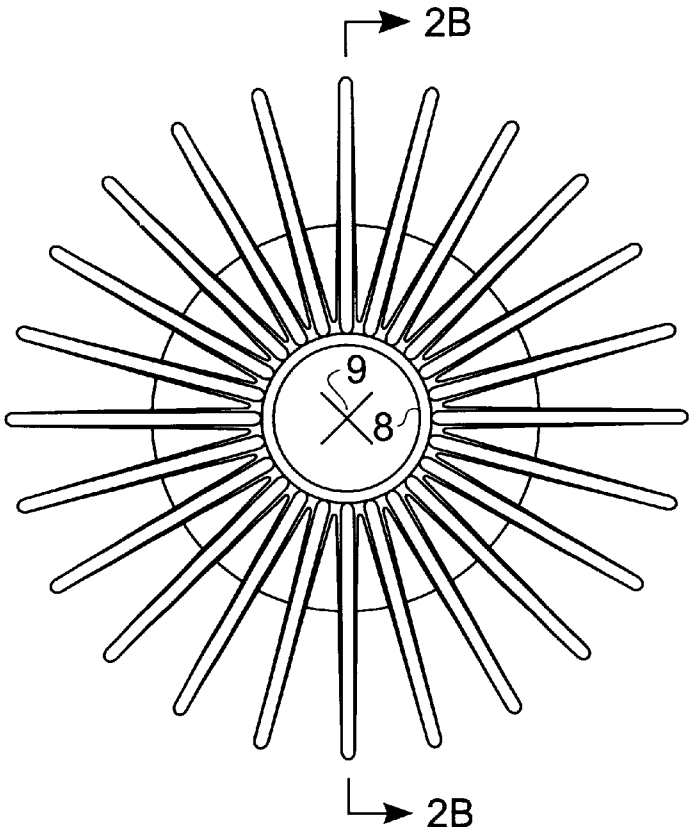

FIGS. 2A and 2B are top and side sectional views of an alternative embodiment of the invention in which a central spine 8 which is aligned on a central axis 9 of the ball and perpendicular to the central parting line plane, designated 4'. In this embodiment, the central spine is hollow. The hollow spine permits more rapid cooling in the mold and is especially desirable when the diameter of the central spine exceeds 0.25 inches.

Figure 3A:
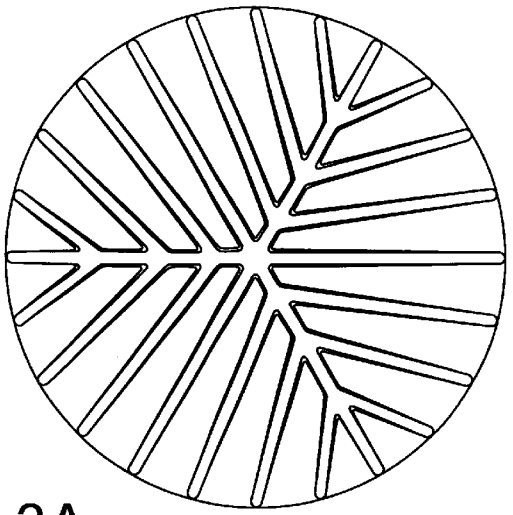
FIGS. 3A–3D are plan views of further alternative ball embodiments.
Figure 3B:
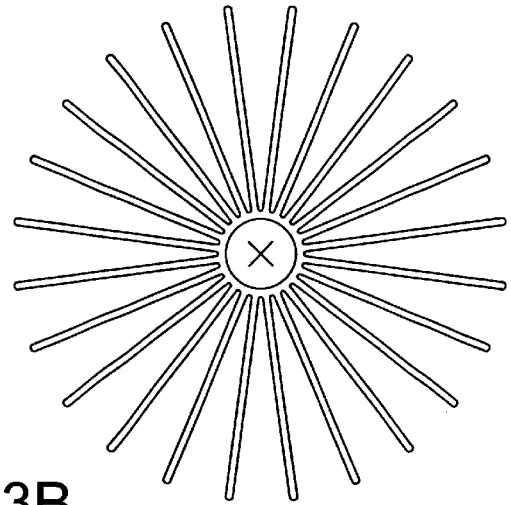
Figure 3C:
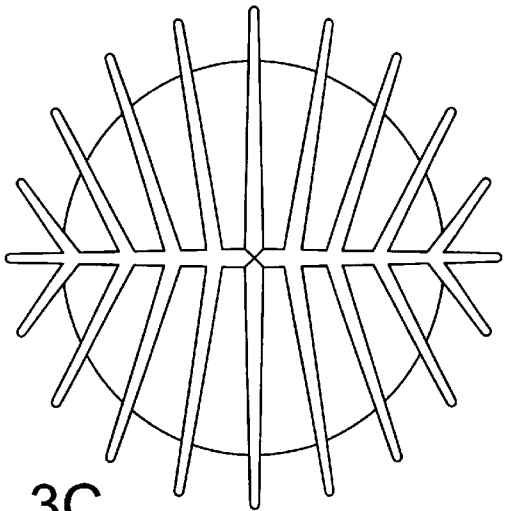
Figure 3D:
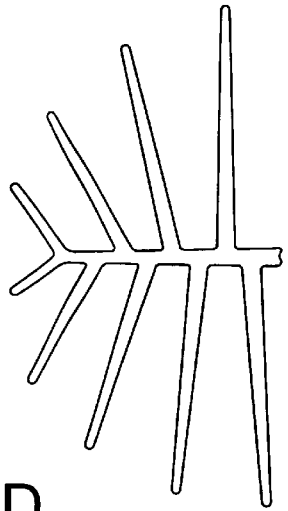

FIGS. 3A, 3B, 3C, and 3D show additional embodiments (FIG. 3D is a fragment view). These are plan views along the lines of FIGS. 1A and 2A, with the parting line plane extending in the plane of the figure.

In use the ball may be used for most play and sporting activities employing balls. Such activities include the games of catch, baseball, dodgeball, hand juggling, foot juggling, paddle-ball, etc.

A preferred embodiment of the present invention is molded from soft thermoplastic elastomer SEBS (Styrene-Ethylene-Butadiene Resin) resin. Very soft resins, having Shore-A durometers of less than 20 make a ball of particularly nice tactile qualities. A specific preferred embodiment is made of SEBS having a Shore-A durometer range of 8–18. For sports such as the game of baseball, it may be preferable to mold the ball from harder elastomers having a Shore-A durometer range of 20 to 60. For other sports such as bowling, rigid or semi-rigid materials, such as polyethylene may be preferred.

What is claimed is:

1. An injection molded thermoplastic ball comprising:

a central parting line plane substantially bisecting said ball;

a single central member adjacent to said central parting line plane, said central member having a single upper surface and a single lower surface; and a plurality of fins, some of which are joined to said upper surface of said central member and all remaining ones of which are joined to said lower surface of said central member;

the outermost edges of said fins defining a sphere;

all fins on said ball being oriented so as to radiate at substantially right angles from a said central parting line plane, such that said ball may be injection molded by injection of thermoplastic material into a mold and that when said mold opens at said parting line said ball may be freely released.

2. The ball of claim 1 in which each of said fins is tapered in thickness with maximum thickness at the root of said fins and minimum thickness at said outermost edges.

3. The ball of claim 1 in which said central member is a central plate adjacent to said central parting line plane.

4. The ball of claim 3 comprising additional stiffening ribs which stabilize said fins in relation to said central plate.

5. The ball of claim 1 in which said thermoplastic material is thermoplastic elastomer.

* * * * *